United States Patent [19]

Foley et al.

[11] Patent Number: 4,676,058

[45] Date of Patent: Jun. 30, 1987

[54] WIRE ROPE WITH DUCTILE CORE

[75] Inventors: William L. Foley, Libertyville Township, Lake County, Ill.; James H. Bauer, Kenosha, Wis.

[73] Assignee: Amsted Industries Incorporated, Chicago, Ill.

[21] Appl. No.: 871,882

[22] Filed: Jun. 9, 1986

[51] Int. Cl.[4] ..... D07B 1/06; D07B 1/08

[52] U.S. Cl. ..... 57/218; 57/212; 57/214

[58] Field of Search ..... 57/200, 210, 211, 212, 57/213, 214, 216, 218, 220, 222, 225, 231, 236, 237

[56] References Cited

U.S. PATENT DOCUMENTS

| | | | |
|---|---|---|---|
| 1,759,410 | 5/1930 | Marston | 57/222 |
| 2,792,868 | 5/1957 | Benson | 57/212 X |
| 3,131,530 | 5/1964 | Dietz | 57/220 X |
| 3,778,994 | 12/1973 | Humphries | 57/214 |
| 4,176,705 | 12/1979 | Russell et al. | 57/220 X |
| 4,463,219 | 7/1984 | Sato | 57/221 X |

*Primary Examiner*—Donald Watkins

*Attorney, Agent, or Firm*—Charles E. Bouton; Edward J. Brosius

[57] ABSTRACT

Small diameter wire rope having a relatively ductile and preferably solid core is found to be strong yet better resists shearing forces than similar rope having a high strength core strand.

5 Claims, 1 Drawing Figure

WIRE ROPE WITH DUCTILE CORE

BACKGROUND OF THE INVENTION

This invention relates in general to an improved wire rope and more particularly relates to an improved small diameter wire rope with a ductile metal core.

Within the wire rope industry there is a class of relatively small diameter products that are known by the term "aircraft cable". The term probably was chosen at a time when strong small diameter wire rope was developed for a wide number of applications in aircraft for controls and for bracing and the like. Such wire rope continues to be used in such applications and additionally aircraft cable finds many other uses such as in yacht rigging, small hoists, tie rods, machine parts and slings. In many applications it is used as a security device with swaged fittings completing a closed loop which is tamper resistant.

Usual aircraft cable type wire rope runs from about 1/32 to 1½ inch in diameter and is comprised of seven strands heliacally arranged about a wire strand core. Each strand is made up of multiple wires (typically 7 thru 41 wires) which may be high strength regular, tinned, galvanized or stainless steel. Also the wire rope may be lubricated or non-lubricated depending on bending and corrosion service conditions. The cables and particularly the outer strands have been formed of relatively high carbon content steel wire (typically 0.6%–0.8% Carbon) having a high resistance to abrasion and bending fatigue and a high tensile strength.

The latter qualities however involve high material cost and result in wire rope that is relatively weak to shearing forces (and therefore is relatively easily cut) and tends to restraighten when bent and released. Yet in many applications, particularly those involving safety and security uses, it is desirable that the wire rope be resistant to shear and able to retain a bent shape.

SUMMARY OF THE INVENTION Therefore it is an object of the present invention to provide a wire rope that is economical and strong. It is another object of the present invention to provide a small diameter wire rope that is resistant to shear.

It is a further object of the present invention to provide a small diameter wire rope that will retain bent shape.

Generally the present invention is a small diameter wire rope of approximately ¾ inch and less diameter having a plurality of outer strands of multiple wires surrounding a single solid wire core comprised of a ductile metal.

DESCRIPTION OF THE DRAWINGS

Further objects and advantages will become apparent from the following detailed description taken in conjunction with the drawings wherein the single

DETAILED DESCRIPTION OF THE INVENTION

Figure 1:
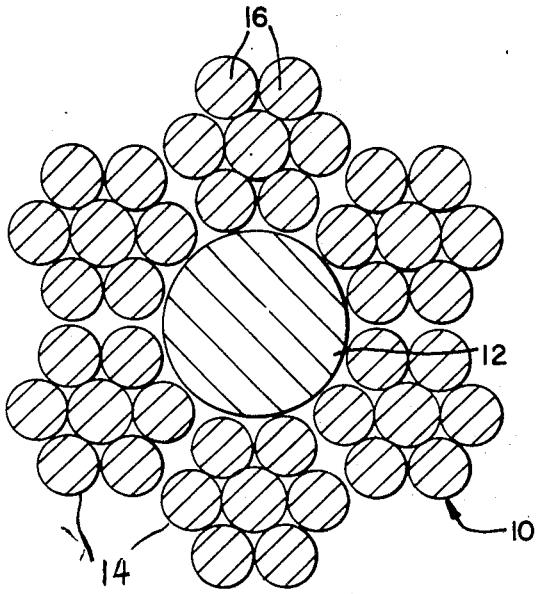
FIG. 1 is a cross section view of a wire rope embodiment of the present invention.

As may be seen in the drawing a preferred embodiment of the present invention comprises a wire rope generally 10 having a solid wire core 12 surrounded by six strands 14 each comprised of seven wires 16. For small diameter cables there are usually no more than seven outer strands; however the number of wires in each strand may range upwardly to forty-one.

The core and strands are of substantially equal diameter being each about one third of the wire rope diameter; however it has been found that the solid core wire of the present invention may be only about 90% of diameter of a multiple wire strand core of the prior art.

In the outer strands 14 the wires 16 are helically wound about a central wire and the strands 14, in turn, are helically wound about the core 12. The wires 16 are preferably of relatively high tensile strength and hard nonductile iron or steel to resist abrasion, crushing and fatigue. However it is important in the present invention that the core 12 comprise no more than a few and preferably a single solid wire of a relatively ductile material, either a ferrous or non-ferrous metal, such as aluminum, and may range up to one quarter inch in diameter.

It is believed that at diameters substantially above ¼ inch a solid ductile core would be too large and stiff to be practical and a multiple wire, such as three wires, core may be needed for flexibility.

The ductile core may be of low carbon iron (less than grade 1078), annealed iron, stainless steel (grades 302, 204 and the like) aluminum or other ductile metal that can be drawn into a single wire of the desired diameter. Ductility relates to a characteristic of permanent or plastic deformation occurring in the metal before fracture. It has been found that for the present invention ferrous metal wire of 0.16% to 0.6% (low) carbon content is suitable. Such wire may be annealed or partially drawn to increase tensile strength; but drawing must be controlled as it will tend to reduce ductility while increasing strength and hardness. As a rough indicator of suitable ductility one may measure Rockwell or Brinell hardness which should range downward of 40 Rockwell "C" (372 Brinell) to a minimum of about 80 Rockwell "B" (about 150 Brinell) in the ductile core, whereas the outer strand wire may typically be 42–48 Rockwell "C" (393–460 Brinell). The wires 16 of outer strands 14 are substantially less ductile than the core 12 and are preferably comprised of high strength steel that is either stainless steel or protectively coated by tin or zinc (galvanized).

According to the specific application intended for the wire rope it may be either lubricated or non-lubricated. Lubrication is preferred for wire rope that will be repeatedly cycled through bending and also for wire rope that may need extra protection from corrosive environments. Suitable lubricants are known to the industry such as hot applied asphaltic base, cold applied petroleum oil base, hot or cold applied petrolatum base, hot or cold lithium soap base and light paraffin oils. There are still further lubricants that are suitable.

It has been found that wire rope manufactured as above described with a relatively ductile single wire core is more resistant to shearing forces and seems to absorb such forces within the core. Thus such wire rope is more resistant and difficult to cut than wire rope of equal diameter having a multiple wire core resembling the outer strands. Accordingly the wire rope of the present invention is highly desirable for security type applications which must be resistant to tampering. Additionally the ductile core wire rope will tend to retain the shape to which it is bent thus facilitating handling during installation and also contributing to reduced exposure of the wire rope to thereby lessen potential tampering.

Specific examples of wire rope made according to the present invention are as follows:

1. A 3/16 inch diameter non-lubricated cable comprising a 0.062 inch (16 gauge) diameter core of 1064 grade annealed steel wire of 0.6–0.7% carbon content hardness of 21–37 Rockwell "C" (235–342 Brinell), and breaking strength of less than 400 lbs. (tensile strength in the range of 100,000–150,000 lbs. per square inch) surrounded by six strands each being made up of seven 1062 grade galvanized steel wires of about 0.012 inch diameter and having strength of about 350,000 lbs. per square inch. The cable displayed a breaking strength in excess of 3700 lbs. This cable is useful in security applications where there is no cyclic bending.

2. A similar cable was manufactured using a 0.080 inch (14 gauge) diameter 1040 grade annealed steel core having 0.37≅0.44% carbon content similar hardness and 600 lb. breaking strength. The finished cable having galvanized 350,000 psi steel outer strands, displayed breaking strength in excess of 3700 lbs.

3. A 3/32 inch diameter non-lubricated cable was made up using an 1017 grade as-drawn iron wire core of 0.035 inch diameter having a carbon range of 0.15–0.20%, hardness of 33–34 Rockwell "C" (305–313 Brinell), and tensile strength of about 945 lbs. The outer strands were 0.010 inch diameter galvanized 350,000 psi wire, and the cable met the air craft cable minimum strength requirement of 920 lbs. This cable is useful as a reinforcement member for drum seals.

4. A ¼ inch diameter non-lubricated cable was made up using a 1017 grade as-drawn galvanized iron wire core of 0.098 inch diameter. The carbon range was 0.15 to 0.20%, the hardness was 33–34 Rockwell "C" (305–313 Brinell) and the tensile strength was about 685 lbs. The outer strands were comprised of wires of about 0.010 inch diameter galvanized wire of 350,000 psi. The cable breaking strength was in excess of 6,900 lbs. This cable is useful in security applications where some cyclic bending is encountered.

The foregoing detailed description has been given for clearness of understanding and to provide a complete description of a preferred embodiment of the invention. Various modifications may be made without departing from the spirit and scope of the invention which is defined in the following claims.

What is claimed is:

1. An improved small diameter wire rope of up to about three fourths inch diameter comprising:

a single solid wire core of about one third the wire rope diameter, said core being comprised of a relatively ductile metal;

and at least six outer strands surrounding said core each of said strands consisting of at least five wires of low ductile high strength iron or steel having resistance to abrasion, crushing and fatigue.

2. An improved small diameter wire rope of claim 1 wherein said core is ductile iron.

3. An improved small diameter wire rope of claim 1 wherein said core is a ductile non-ferrous material.

4. An improved small diameter wire rope of claim 1 in said core is ductile aluminum.

5. An improved small diameter wire rope of claim 1 wherein the said solid wire core is not substantially greater than ¼ inch in diameter.

* * * * *